US005135318A

United States Patent [19]

Hongo

[11] Patent Number: 5,135,318

[45] Date of Patent: Aug. 4, 1992

[54] THERMAL PRINTER

[75] Inventor: Takayasu Hongo, Kobe, Japan

[73] Assignee: Kanzaki Paper Manufacturing Co., Ltd., Tokyo, Japan

[21] Appl. No.: 558,684

[22] Filed: Jul. 27, 1990

[30] Foreign Application Priority Data

Jul. 31, 1989 [JP] Japan ..... 1-90719[U]

[51] Int. Cl.[5] ..... B41J 2/32

[52] U.S. Cl. ..... 400/120; 400/621; 83/349

[58] Field of Search ..... 400/621, 120, 621.2; 101/288; 358/304; 346/24; 83/349, 613, 694

[56] References Cited

FOREIGN PATENT DOCUMENTS 0037347 3/1980 Japan ..... 400/621
0072883 5/1982 Japan ..... 400/621
0229469 11/1985 Japan ..... 358/304
0049873 3/1986 Japan ..... 400/621
0273869 11/1987 Japan ..... 400/621
0173675 7/1988 Japan ..... 400/621

*Primary Examiner*—Edgar S. Burr
*Assistant Examiner*—Christopher A. Bennett
*Attorney, Agent, or Firm*—Morgan & Finnegan

[57] ABSTRACT

A thermal printer comprising a fixed line thermal head having a heating element array arranged in the line printing direction for carrying out a printing on a sheet and a pair of a cutting blade and a receiving blade for cutting the sheet to a predetermined size after the printing is carried out, in which said receiving blade is fixed to the front end of said thermal head in the sheet feeding direction and the sheet is sandwiched between said receiving and cutting blades.

1 Claim, 3 Drawing Sheets

THERMAL PRINTER

BACKGROUND OF THE INVENTION

1. Field of the Invention

The present invention generally relates to a thermal printer, and more particularly, to a thermal printer having an improved cutting mechanism.

2. Prior Art

Printing methods carried out by a thermal printer are classified into the following two methods: serial printing method for carrying out a printing on a recording sheet while a thermal head is moving in a line printing direction and line printing method in which a fixed-type line thermal head having heating elements corresponding to all dots effects a printing on a sheet.

According to the thermal printer adopting the above conventional method, as shown in FIG. 4, a sheet 2 on which all lines of one page have been sequentially printed by a thermal head 1 is cut to a predetermined size by a cutting device 5, comprising a cutting blade 3 and a receiving blade 4, positioned forward from a printing heating element array 11 of a thermal head 1.

The cutting position 9 of the cutting device 5 is disposed at a long distance forward from the thermal head 1. When the rear end of a sheet portion 7 corresponding to a preceding page is cut, the position corresponding to the front end of a sheet portion 8 corresponding to the subsequent page is positioned at a short distance forward from the heating element array 11. Therefore, the rear end of the sheet portion 7 does not coincide with the front end of the sheet portion 8. That is, the sheet is wasted in the range from the position corresponding to the front end of the sheet portion 8 to the rear end of the sheet portion 7. For this reason, while a printing is carried out, it is necessary to make an adjustment so that the front end of the sheet portion 8 is fed to the cutting position 9 of the cutting device 5.

Time is spent while feeding the front end of the subsequent sheet portion to the cutting position and the sheet is wasted in the range described above. Further, it is necessary to provide the printer with a device which stops the front end of the subsequent sheet portion to be cut at the cutting position and in addition to the time spent for feeding the sheet, an extra cutting period of time is required.

In order to prevent the above time spent, and minimize the loss pieces of sheet unused for printing, it is necessary to position the cutting device as near as possible to the thermal head 1. Although the printer is designed to accomplish this purpose, the cutting blade 3 cannot spatially be positioned rearward of the peripheral surface of a platen roll 10, i.e., the cutting device cannot be positioned near the thermal head 1. Therefore, although the distance between the cutting device and the thermal head 1 is shortened to the greatest extent, it is necessary to provide the printer with a process for feeding the sheet approximately 15mm from the heating element array 11 of the thermal head 1 to the cutting position. This is the reason why a printing cannot be carried out at a high speed and the sheet is wasted.

In another means to minimize the waste of the sheet, it is possible to move the front end of the subsequent sheet portion backward to the heating element array after the sheet is cut, then, perform a printing.

According to this method, the wasted area of the sheet can be decreased, however, it is necessary to provide a printer capable of additionally executing a process for moving the sheet backward. Consequently, the printer is incapable of carrying out a printing at a high speed.

DISCLOSURE OF THE INVENTION

It is the object of the present invention to provide a thermal printer which only wastes a minimum rate of the sheet and is capable of carrying out a printing at a high speed.

In order to accomplish the above object, the present invention provides a thermal printer comprising a fixed line thermal head for carrying out printing on a sheet and a pair of a cutting blade and a receiving blade for cutting the sheet to a predetermined size after the printing is carried out, in which the receiving blade is fixed to the front end of the thermal head in the sheet feeding direction and the sheet is sandwiched between the receiving and cutting blades.

PREFERRED EMBODIMENT OF THE INVENTION

A thermal printer in accordance with the present invention is described below referring to FIG. 1.

Figure 1:
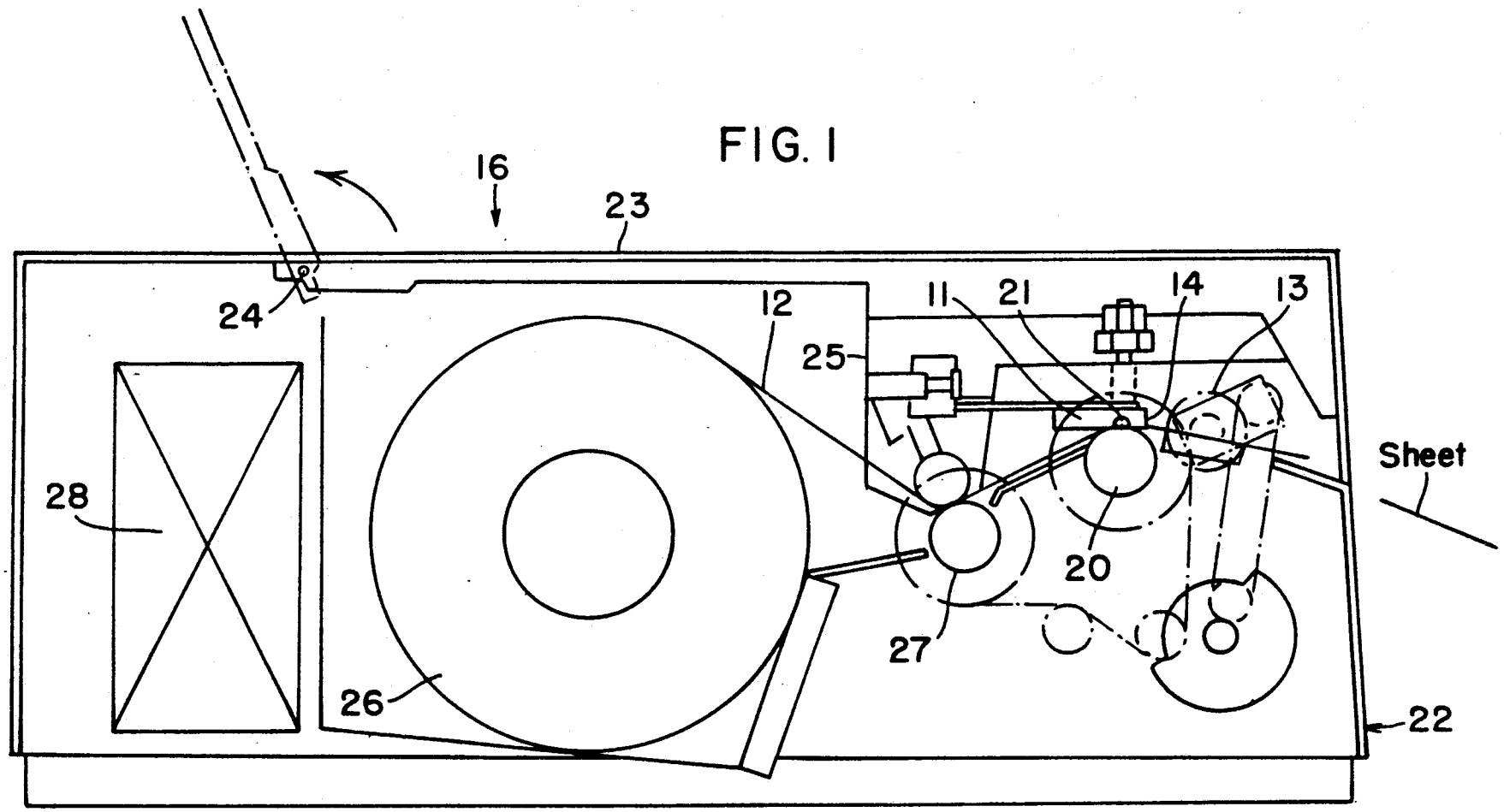
FIG. 1 is a vertical sectional view showing an embodiment of a thermal printer of the present invention using a receiving blade fixed to the front end of a thermal head and a rotary cutter serving as a cutting blade.

As shown in FIG. 1, an upper cover 23 is mounted on the upper portion of a printer case 22 so that the upper cover 23 is rotatable about a hinge 24. A thermal head 11 is attached below the upper cover 23 through an attachment 25 with the heating element array 21 thereof arranged in the line printing direction. There is provided below the thermal head 11 a platen roller 20 mounted on the printer case 22 with the rotational axis thereof along the line printing direction.

The receiving blade 14 of a cutting device 15 is secured to the front end of the thermal head 11 with fastening means such as a screw. A rotary cutter 13, namely, a cutting blade forming a pair with the receiving blade 14 is mounted in the printer case 22 with the rotational axis thereof along the line the printing direction. Referring to FIG. 1, a feed roller 27 is disposed between the platen roller 20 and a roll 26 which is formed of a rolled printing sheet 12. The power source 28 is positioned in the left end of the case 22.

Figure 2:
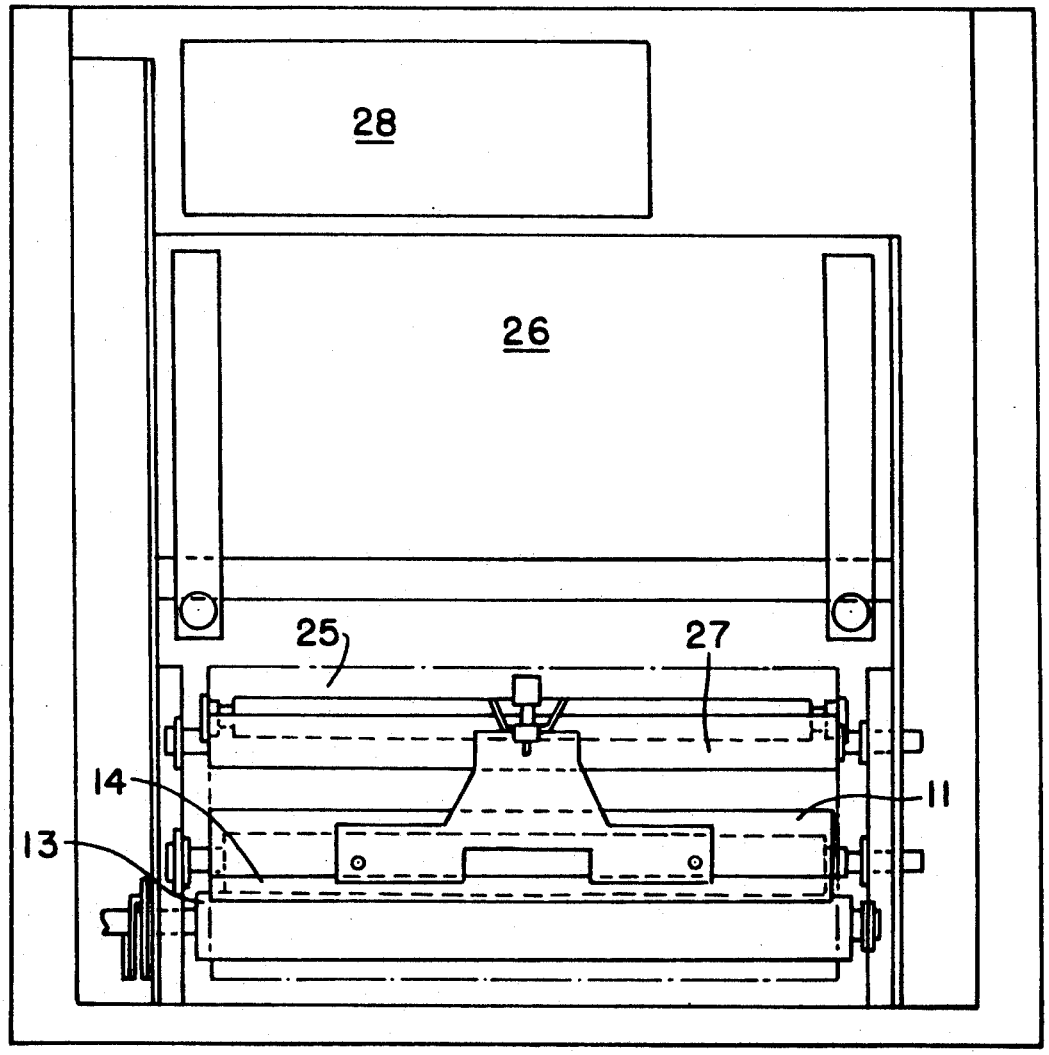
FIG. 2 is a plan view showing the principal portion of the thermal printer.

FIG. 2 is a plan view showing the position and configurations of respective members of the printer shown in FIG. 1.

Referring to FIG. 1, as shown in solid lines, when the upper cover 23 is closed and the power source 28 is turned on, the thermal head 11 is pressed against the platen roller 20 through the sheer 12 fed forward from the roll 26 and a printing is carried out by the heating element array 21 of the thermal head 11. With the thermal printer, the sheet 12 is only fed approximately 5mm from the heating element array 21 to the front end of the receiving blade 14 to carry out a printing on a subsequent page. Thus, a printing period of time is much reduced.

According to this construction, the area of the sheet in which a printing is impossible can be minimized and a recording can be performed at a high speed.

Figure 3:
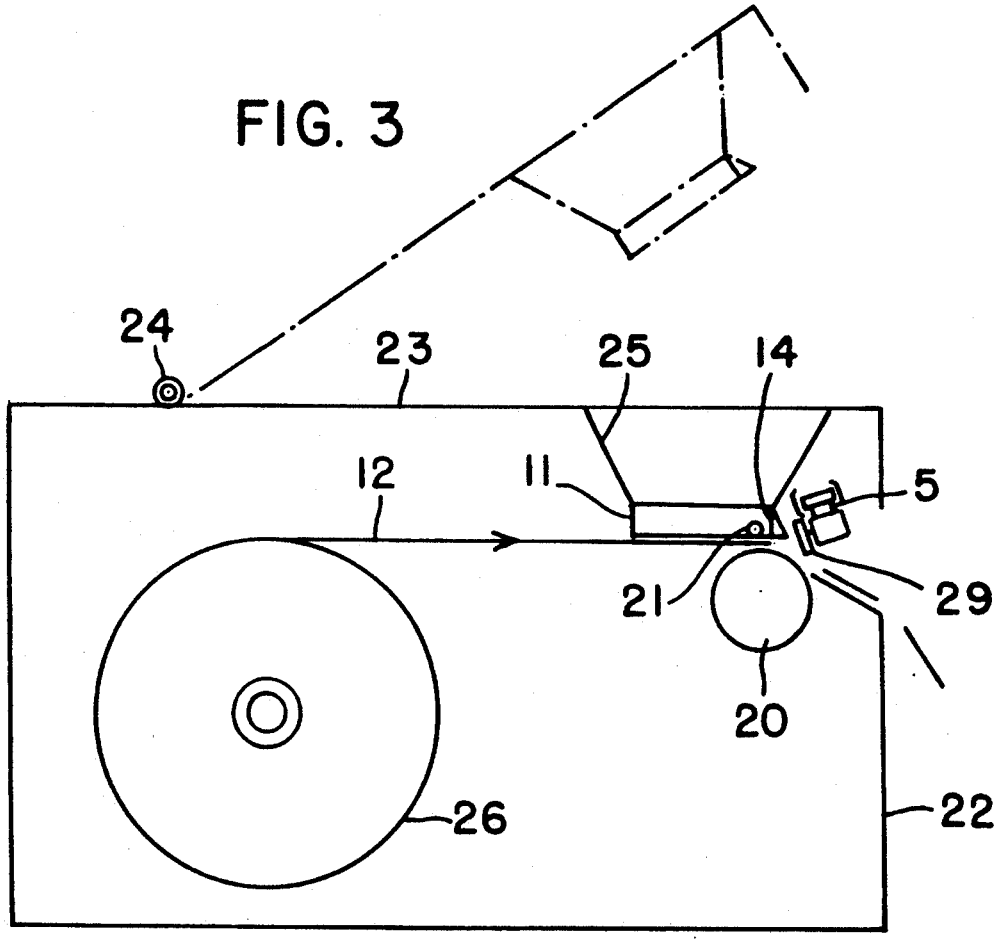
FIG. 3 is a vertical sectional view showing another embodiment of a thermal printer of the present invention using a movable rotary blade serving as a cutting blade.
Figure 4:
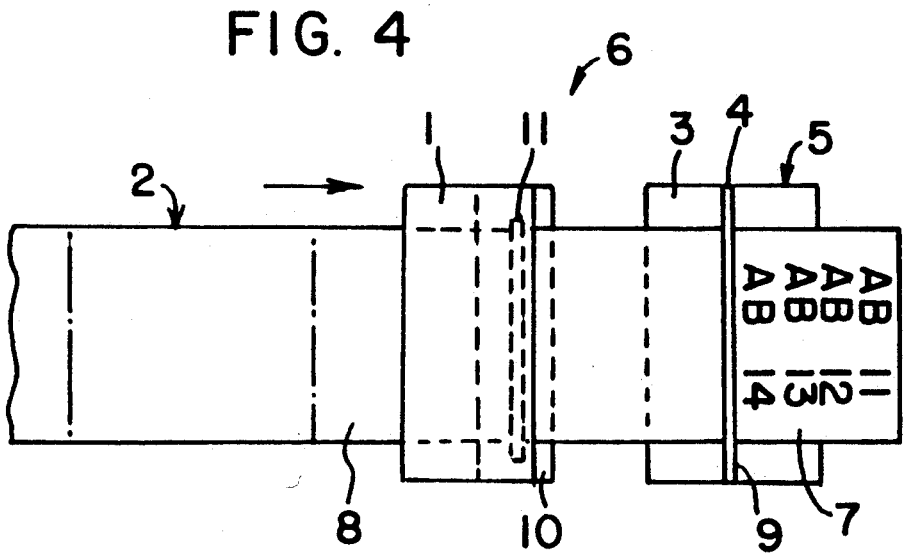
FIG. 4 is a plan diagrammatic view showing a conventional representative thermal printer.

According to the embodiments shown in FIGS. 1 and 2, the cutting device comprises the pair of the cutting blade and the receiving blade. However, a thermal printer 16' as shown in FIG. 3 comprises a rotary blade moving mechanism having a receiving blade and a rotary blade 29 movable in the line printing direction. The rotary blade moving mechanism comprises the driving device 30 for driving a rotary blade 29, a travel wheel 31 fixed to the driving device 30 and driven by a driving device, and a rail 32 provided in opposition to a fixed blade 14. The rail 32 guides the travel wheel 31 thereon in the line printing direction.

Accordingly, in the thermal printer 16', upon generation of a signal indicative of the cutting of the sheet, the driving device 30 is driven to rotate the rotary blade 29 and simultaneously, the driving device for driving the travel wheel 31 is driven. Thus, the rotary blade 29 positioned alongside one side of the sheet is moved to the other side thereof so as to cut the sheet.

Although the present invention has been fully described in connection with the preferred embodiments thereof with reference to the accompanying drawings, it is to be noted that various changes and modifications are apparent to those skilled in the art. Such changes and modification are to be understood as included within the scope of the present invention as defined by the appended claims unless they depart therefrom.

What we claimed is:

1. A thermal printer comprising a fixed line thermal head for carrying out printing on a sheet and a pair of a cutting blade and a receiving blade for cutting the sheet to a predetermined size after the printing is carried out, in which said receiving blade is directly secured to an end portion of said thermal head at a sheet discharging side and said cutting blade is mounted on said printer opposite to said receiving blade with respect to the sheet.

* * * * *